United States Patent [19]

Harrell

[11] Patent Number: 4,854,894

[45] Date of Patent: Aug. 8, 1989

[54] INTERMEDIATE COMPONENT FOR AN ELECTRICAL CONNECTOR AND METHOD OF MANUFACTURE

[75] Inventor: Timothy J. Harrell, Centerville, Ind.

[73] Assignee: Cooper Industries, Inc., Houston, Tex.

[21] Appl. No.: 235,319

[22] Filed: Aug. 23, 1988

[51] Int. Cl.[4] ..... H01R 13/504

[52] U.S. Cl. ..... 439/606; 439/736

[58] Field of Search ..... 439/606, 686, 695, 736, 439/701

[56] References Cited

U.S. PATENT DOCUMENTS

| | | | |
|---|---|---|---|
| 2,391,432 | 12/1945 | Marschner et al. | 219/19 |
| 3,086,251 | 4/1963 | Bernat | 439/695 |
| 3,402,385 | 9/1968 | Feinberg | 339/191 |
| 3,444,618 | 5/1969 | Sorlie | 29/629 |
| 3,594,696 | 7/1971 | Witek, Jr. | 439/736 |

FOREIGN PATENT DOCUMENTS

| | | | |
|---|---|---|---|
| 3510369 | 10/1986 | Fed. Rep. of Germany | 439/695 |
| 1138161 | 6/1957 | France | 439/736 |

*Primary Examiner*—Gary F. Paumen

*Attorney, Agent, or Firm*—Fitch, Even, Tabin & Flannery

[57] ABSTRACT

An intermediate electrical component for application of a molded jacket to form an electrical connector. This component includes a first conductor having a first core formed of strands of metallic wire surrounded by an insulating jacket with a first metallic terminal element mechanically attached to the core at its stripped first end. The component similarly includes a second conductor attached to a second metallic terminal element. The component further includes an electrically insulative body of a thermoplastic material molded about the conductors and terminals with the body having a first end and a second end. The body maintains the terminal elements in spaced relationship with the conductors extending beyond the body second end and the terminal elements being accessible adjacent the body first end. The body has a window extending substantially therethrough and separating the first and second terminal elements adjacent their locations of attachment to the cores of their corresponding conductors. A method of manufacturing this intermediate component and the finished electrical connector is also disclosed.

7 Claims, 4 Drawing Sheets

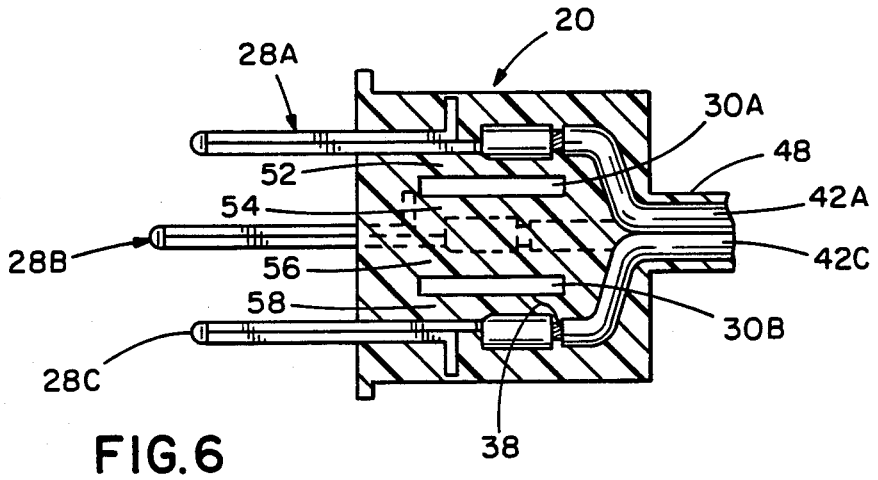
FIG. 6
FIG. 7
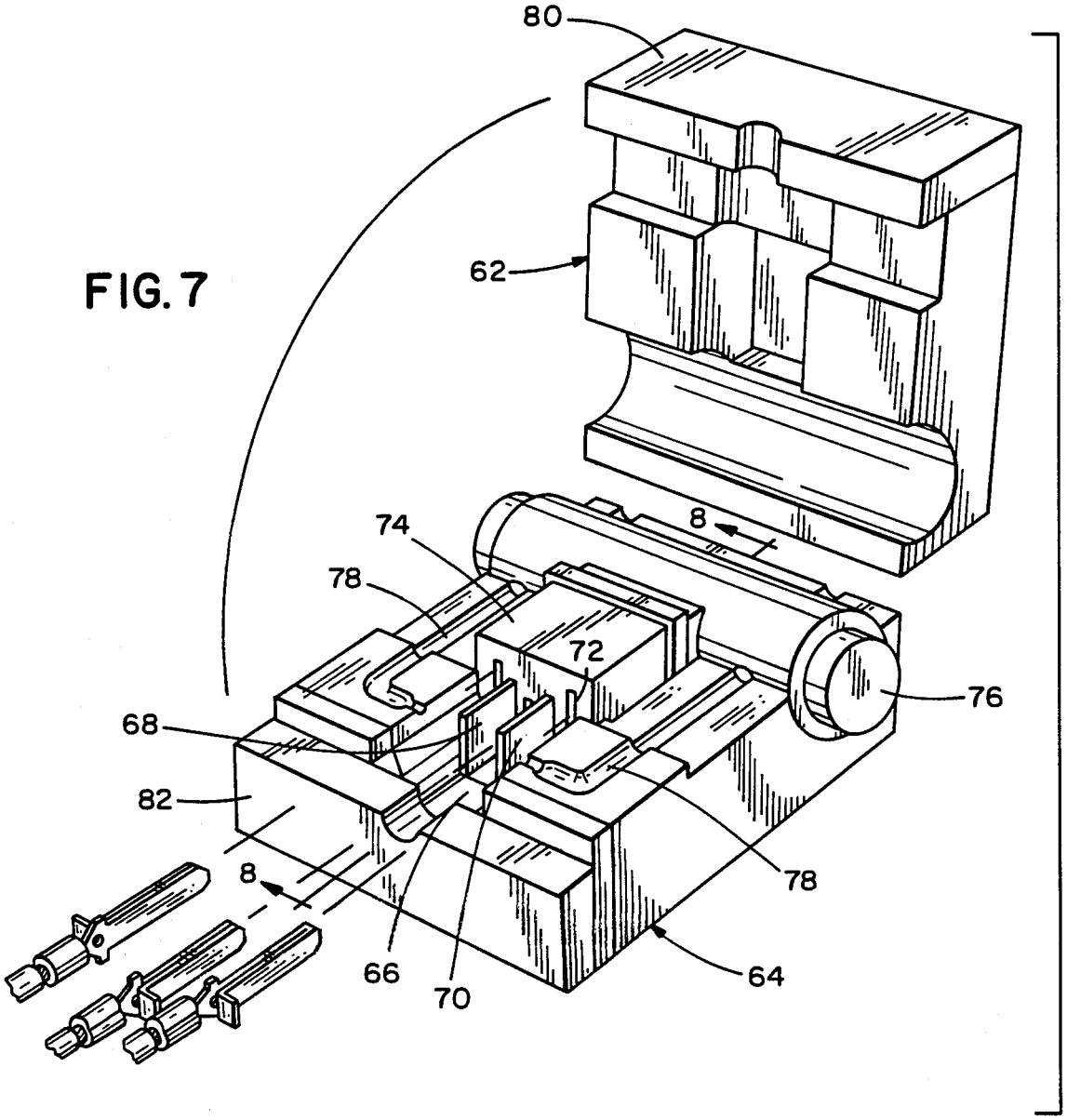

INTERMEDIATE COMPONENT FOR AN ELECTRICAL CONNECTOR AND METHOD OF MANUFACTURE

This invention relates to electrical apparatus and, more particularly, to a molded connector, such as a plug or a receptacle, holding spaced metallic terminal elements.

BACKGROUND OF THE INVENTION

It is known to manufacture connectors, such as plugs and receptacles, with bodies of thermoplastic material molded about terminal elements attached to the metallic cores of insulated conductors. The cores are typically formed of multiple strands of copper wire with the stripped end of the conductor attached to the wire-receiving end of the terminal element, for example, by crimping. The terminal elements with the conductors extending therefrom are held by a jig so that the insulative body can be molded about the spaced terminal elements.

Occasionally the attachment of the terminal element to the core, which is typically accomplished by automated equipment, is improper in that there is a loose strand of the core free of the wire-receiving end of the terminal element. After completion of molding the body, this loose strand might contact another core or terminal element, or a loose strand of an adjacent core, resulting in a short. To prevent a connector with an internal short from reaching the consumer, a continuity test is performed after manufacture and shorted connectors scrapped.

One proposed method of forming an electrical connector involves forming the terminal elements with a bridging portion to hold them in spaced relationship. After the terminal elements are connected to the stranded cores of the conductors, the arrangement is placed in a mold with movable shearing members moving in the mold cavity to sever the bridging portion. After the movable shearing members are withdrawn from the cavity, insulating material is introduced into the cavity to form the connector body. For further information concerning this method, reference may be made to U.S. Pat. No. 3,444,618.

SUMMARY OF THE INVENTION

Among the various aspects and features of the present invention may be noted the provision of an improved electrical connector and a method of its manufacture. The method includes formation of an intermediate component having an insulative body with openings between adjacent terminals through which loose strands from the stranded cores are positively prevented from passing. The windows are later filled with insulation to preclude shorting. Thus the need for a post-manufacturing continuity check is precluded, and the number of plugs required to be scrapped is reduced. The resulting connector has long service life, is reliable in use, and is easy and economical to manufacture. Other aspects and features of the present invention will be, in part, apparent and, in part, pointed out specifically hereafter in the following specification and drawings.

Briefly, an intermediate electrical component of the present invention for application of a molded jacket to form an electrical connector includes a first conductor having a first core formed of strands of metallic wire surrounded by an insulating jacket with a first metallic terminal element mechanically attached to the core at its stripped first end. The component similarly includes a second conductor attached to a second metallic terminal element. The component further includes an electrically insulative body of a thermoplastic material molded about the conductors and terminals with the body having a first end and a second end. The body maintains the terminal elements in spaced relationship with the conductors extending beyond the body second end and the terminal elements being accessible adjacent the body first end. The body has a window extending substantially therethrough and separating the first and second terminal elements adjacent their locations of attachment to the cores of their corresponding conductors.

As a method of manufacturing an electrical connector, the invention includes the following steps:

(a) First and second metallic terminal elements, which are attached to respective stripped ends of first and second conductors having cores of stranded wire, are positioned in spaced relationship.

(b) A body of an insulative thermoplastic material is molded about the terminal elements and conductors.

(c) A window is formed in the body and extends through the body so that it separates the first and second terminal elements at their locations attachment to the cores of their corresponding conductors. and (d) An outer jacket of a thermoplastic insulative material is molded about the body. Material applied during this molding step substantially fills the window.

BRIEF DESCRIPTION OF THE DRAWINGS

FIG. 6 is a sectional view taken generally along line 6—6 of FIG. 1 showing a stray strand from one of the conductor cores extending to one of the windows;

FIG. 7 is a perspective view of upper and lower die members for forming the component of FIG. 1;

Corresponding reference characters indicate corresponding components throughout the several views of the drawings.

DESCRIPTION OF THE PREFERRED EMBODIMENTS

Figure 1:
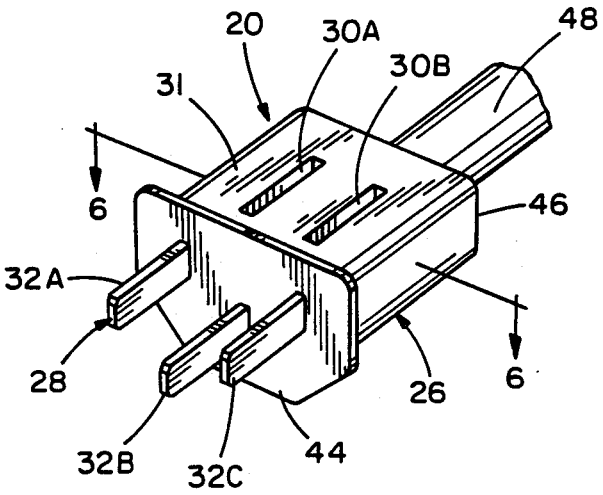
FIG. 1 is a perspective view of an intermediate electrical component for a plug.

Referring now to the drawings, an intermediate component for an electrical connector is indicated in FIGS.

Figure 2:
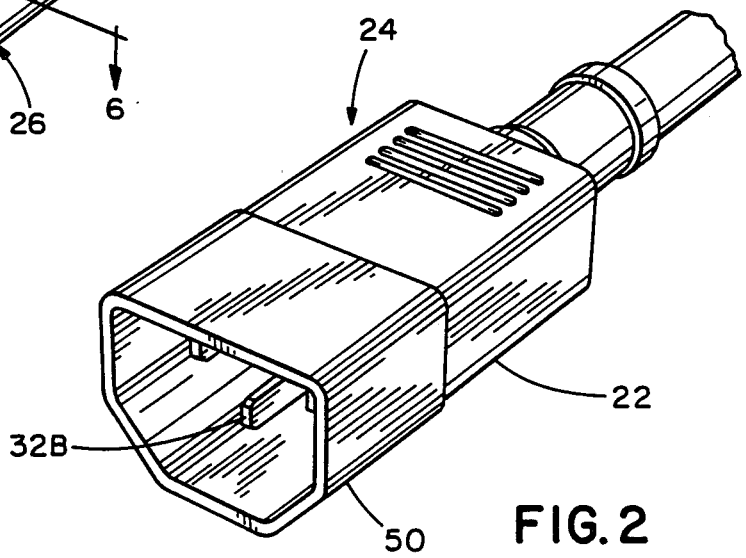
FIG. 2 is a perspective view of the finished plug.

1, 5 and 6 by reference numeral 20. An outer jacket 22 is molded about the intermediate component 20 to form a finished plug 24, as shown in FIG. 2. The intermediate component includes an insulative body 26 of molded thermoplastic material, such as polyvinyl chloride (PVC), holding metallic terminal elements 28 in spaced relationship. A window 30 extends between each pair of adjacent terminals. Each window is formed by the presence of a molding member which positively prevents a stray wire of a conductor attached to one element 28 from contacting another element 28 to form a short. After the material forming the body solidifies to "freeze" any stray wire, the outer jacket 22 is formed, in a subsequent molding operation, to fill the windows and to encompass the outer surface 31 of the body 26 to cover with insulation any strand that might extend to a window or the outer surface of the body.

Figure 3:
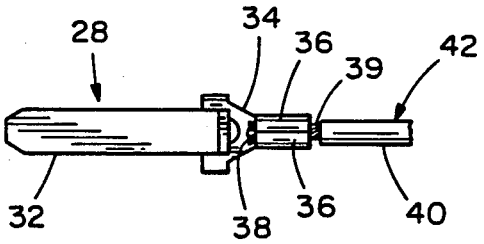
FIG. 3 is a side elevational view of a metallic terminal element attached to the stripped end of a conductor with a stranded core.

More specifically and referring to FIG. 3, each terminal element 28 includes a mating end 32, which for a plug is in the form of a blade, and a wire-receiving end 34. The end 34 could be in the form of a barrel or a pair of arms 36 which are crimped about the copper strands or wires 38, typically seven in number, which form the core 39 from which the insulative jacket 40 is stripped away at a first end of a conductor 42. The component 20 typically includes three terminal elements 28, hot, neutral and ground, with the ground positioned between and at a lower level than the hot and the neutral.

The body 26 has a first end 44 and a second end 46, and maintains the three terminal elements with their corresponding conductors 42 in spaced relationship. The conductors 42 extend beyond the body 26 at its second end 46 and are preferably held in an outer jacket 48. The mating ends 32 of the terminal elements 28 are accessible for connection to corresponding terminal elements of a mating connector at the first end 44 of the body 26. If the connector 24 is a plug, the mating ends 32 extend beyond the body first end 44. The completed plug 24, shown in FIG. 2, can include an insulative shroud 50 formed in the same molding operation as the body outer jacket 22, to extend over the mating ends thereby protecting the user from a shock as the plug is inserted into a receptacle.

Referring to FIG. 6, the body 26 includes interior walls 52 and 54 which define one of the windows 30A and interior walls 56 and 58 which define the other window 30B. Each of these interior walls spaces its window from a corresponding terminal element. A loose strand or wire 38 is shown extending through wall 58 to the window 30B. However, the strand does not extend into the window.

Figure 4:
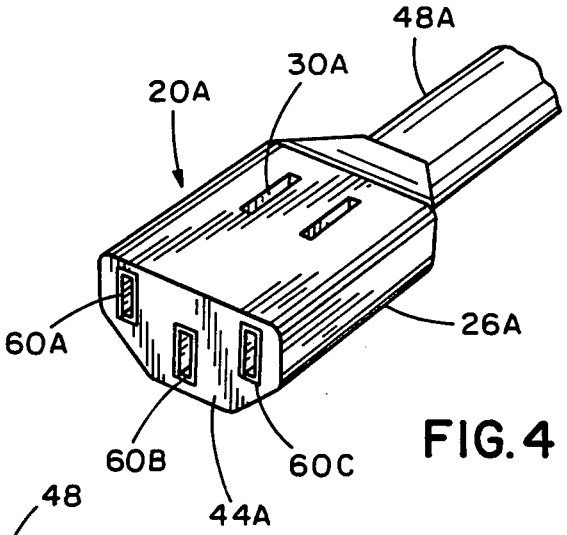
FIG. 4, similar to FIG. 1, shows an intermediate electrical component for a receptacle.
Figure 5:
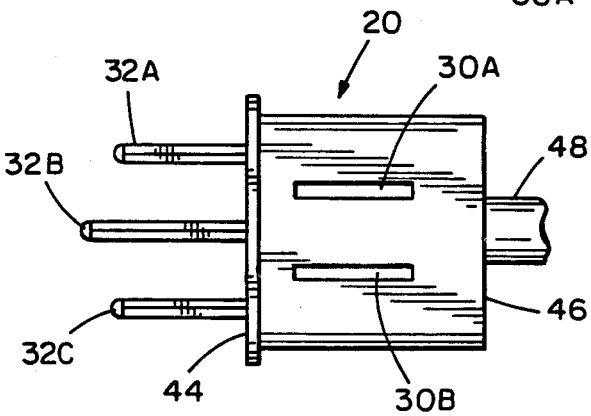
FIG. 5 is a plan view of the component of FIG. 1, illustrating a pair of spaced windows extending through the body of the component.
Figure 8:
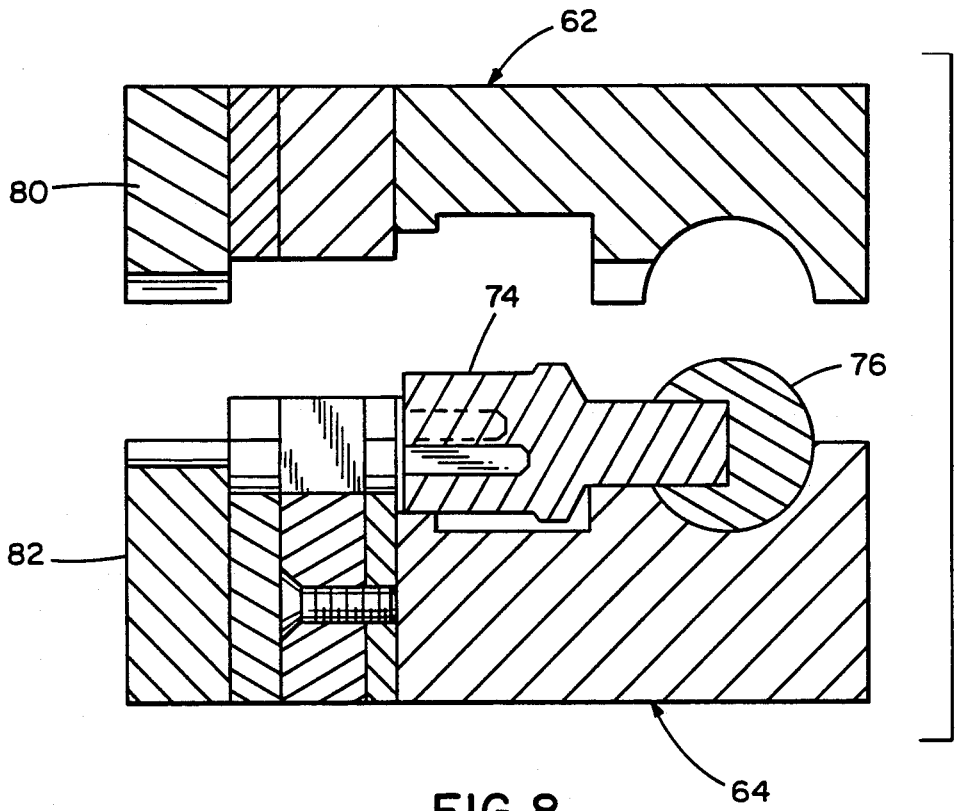
FIG. 8 is a sectional view taken generally along line 8—8 of FIG. 7 except showing the upper die member in spaced, overlying relationship to the lower die member.
Figure 9:
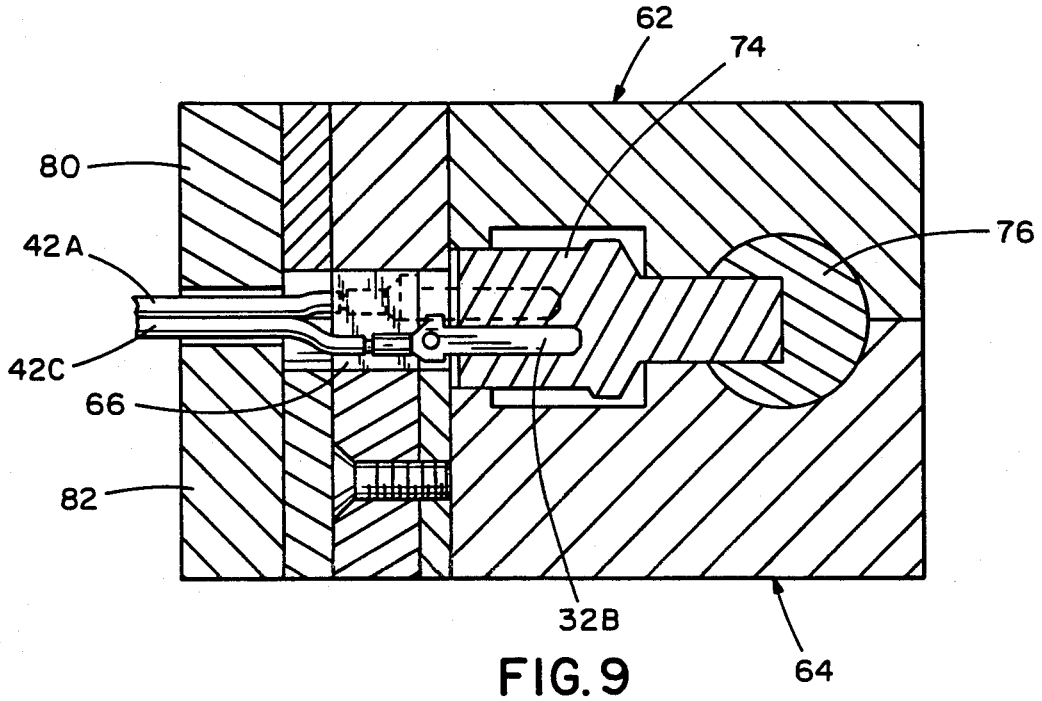
FIG. 9, similar to FIG. 8, shows the die members closed to define a molding cavity for forming the component of FIG. 1.
Figure 10:
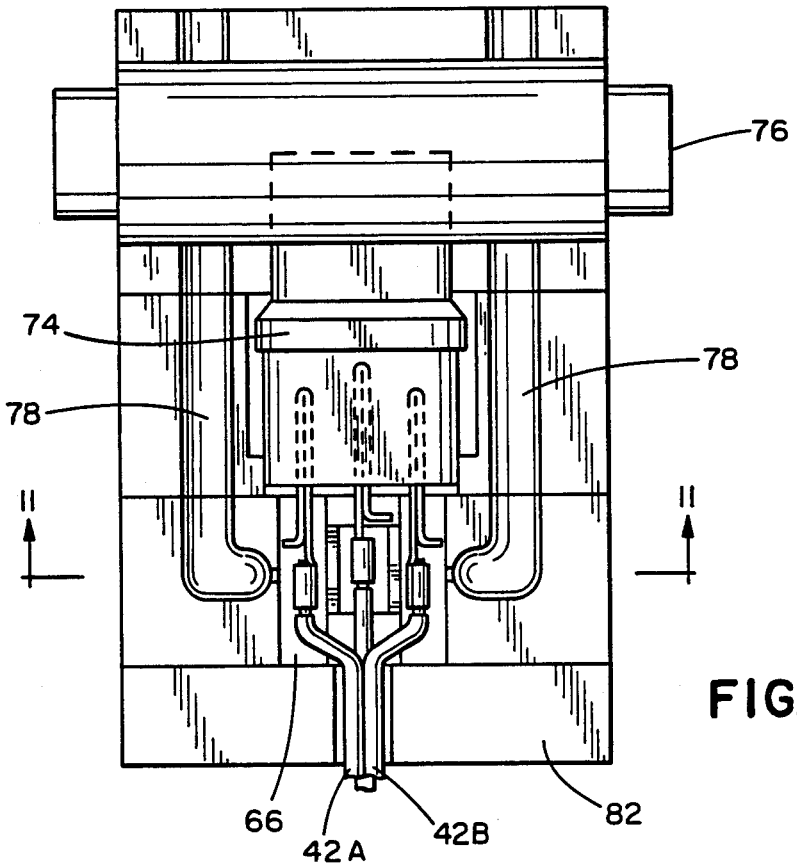
FIG. 10 is a plan view of the lower die member with a jig insert holding and locating the various terminals to be included in the plug.
Figure 11:
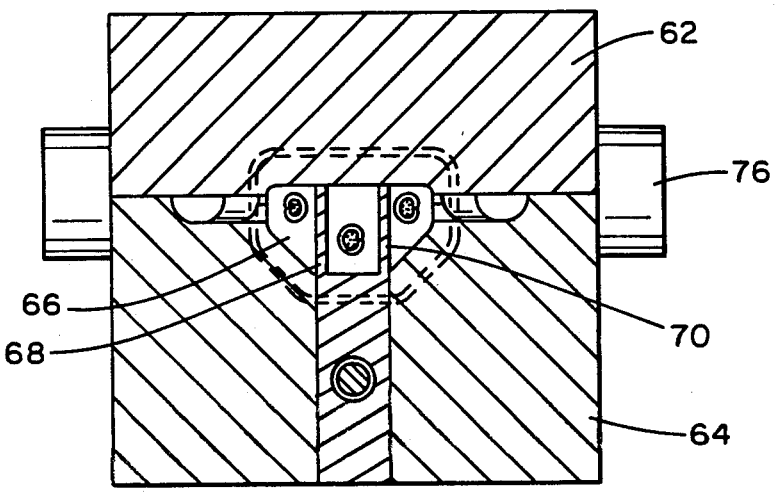
FIG. 11 is a sectional view taken generally along line 11—11 of FIG. 10, except showing the upper die member cooperating to define the molding cavity.

An alternative embodiment of the intermediate component is shown in FIG. 4 at 20A. Component 20A, after application of an outer jacket, forms a receptacle. The main difference between components 20 and 20A is that in component 20A the mating ends 60 of the terminal elements are female blade receivers. As such receivers are well known to those of skill in the art, they need not be further described here. The blade receivers are preferably substantially coterminous with the first end 44A of the body 26A.

Molding apparatus, in greatly simplified form, for forming the body 26 about the terminal elements 28 holding their respective conductors 42, is shown in FIGS. 7–11. Referring to FIG. 7, the molding apparatus includes an upper die member 62 and a lower die member 64 which cooperate to define a molding cavity 66 for forming the body 26. Extending upwardly from the floor of the lower die member 64 are a pair of spaced walls 68, 70 which function to form the windows 30A, 30B, respectively.

The mating ends 32 of the terminal elements 28 are held in spaced relationship by virtue of their insertion in openings 72 of a jig block 74 removably located in the lower die member and held by an arbor 76. Channels 78 are provided in the lower die member 64 for providing the heated, liquid plastic material to the cavity 66 to form the body 26. The die members 62, 64 carry corresponding front plates 80, 82, respectively, which together define an opening for receiving the extending conductors 42. After the body cools to solidify, the upper die member can be removed and the arbor 76 employed to move the intermediate component 20 to other molding apparatus where the outer jacket 22 is molded about the body 26 to fill the windows 30A, 30B and to cover any loose strands 38 which might extend to the outside surface 31 of the body 26.

The thermoplastic material used in the second molding operation to form the outer jacket 22 could be the same material used in the first molding operation to form body 26, preferably a PVC compound. The thermoplastic material in the molding machine is heated to approximately 350° F. The body 26 does not breakdown or melt in the second molding operation. The cooled body 26 represents a relatively large mass of cured compound. Over this is placed the relatively thin outer jacket 22 in the second molding operation. The temperature of the molding compound is reduced to much less than 350° F. before it reaches the second molding cavity because it passes through various components of the molding machine and transfers heat to these components. The body 26 functions, in essence, as a heat sink for the thin layer applied in the second molding operation.

As a method of manufacturing an electrical connector such as a plug or a receptacle, the present invention includes the following steps:

(a) First and second metallic terminal elements 28, which are attached to respective stripped ends of first and second conductors 42 having cores 39 of stranded wire, are positioned in spaced relationship;

(b) A body 26 of an insulative thermal plastic material is molded about the terminal elements and conductors. The body has a first end 44 adjacent which the terminals are accessible for engagement by terminals of a mating electrical connector, and the body has a second end 46 passed which the conductors 42 extend;

(c) A window 30 is formed in the body 26 and extending through the body so that it separates the first and second terminal elements 28 at their locations attachment to the cores 39 of their corresponding conductors 42; and (d) An outer jacket of a thermal jacket insulative material is molded about the body 26. Material applied during this molding step substantially fills the window 30.

It will be appreciated to those of skill in the art that this intermediate electrical component 20 and its method of manufacture are particularly well suited for use with automated equipment.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An intermediate electrical component for application of a molded jacket there around to form an electrical connector such as a plug or a receptacle, said component comprising:

a first conductor having a first core formed of strands of metallic wire surrounded by an insulative jacket, said conductor having a first end from which said insulative jacket has been removed;

a first metallic terminal element mechanically attached to said core at said first end;

a second conductor having a second core formed of strands of metallic wire surrounded by a second insulative jacket, said second conductor having a first end from which said second jacket has been removed;

a second metallic terminal element mechanically attached to the core of said second conductor at the first end of said second conductor; and an electrically insulative body of a thermoplastic material molded about the aforementioned conductors and terminals, said body having a first end and a second end and maintaining said first terminal element spaced from said second terminal element, said first and second conductors extending beyond said body at its second end and said first and second terminal elements being accessible adjacent the body first end for engagement with corresponding terminal elements of a mating electrical connector, said body having a window through which air may flow extending substantially therethrough and separating the first terminal element adjacent its location of attachment to the core of said first conductor from the second terminal element adjacent its location of attachment to the core of said second conductor, said window being spaced from said first and second terminal elements by walls of the thermoplastic material forming said body, at least one of said first and second cores having at least one loose strand extending to said window whereby the presence of said window prevents shorting of loose strands of said cores.

2. An electrical component as set forth in claim 1 wherein said first and second terminal element extend beyond said body first end.

3. An electrical component as set forth in claim 1 wherein said first and second terminal elements are substantially coterminous with said body first end.

4. An intermediate electrical component for application of a molded jacket there around to form an electrical connector, such as a plug or a receptacle, said component comprising:

a first conductor having a first core formed of strands of metallic wire surrounded by an insulative jacket, said conductor having a first end from which said insulative jacket has been removed;

a first metallic terminal element mechanically attached to said core at said first end;

a second conductor having a second core formed of strands of metallic wire surrounded by a second insulative jacket, said second conductor having a first end from which said second jacket has been removed;

a second metallic terminal element mechanically attached to the core of said second conductor at the first end of said second conductor; and an electrically insulative body of a thermoplastic material molded about the aforementioned conductors and terminals, said body having a first end and a second end and maintaining said first terminal element spaced from said second terminal element, said first and second conductors extending beyond said body at its second end and said first and second terminal elements being accessible adjacent the body first end for engagement with corresponding terminal elements of a mating electrical connector, said body having a window through which air may flow extending substantially therethrough and separating the first terminal element adjacent its location of attachment to the core of said first conductor from the second terminal element adjacent its location of attachment to the core of said second conductor, said component further comprising a third conductor having a third core formed of strands of wires surrounded by a third insulative jacket, said third conductor having a first end from which said jacket has been removed, said component also including a third metallic terminal element mechanically attached to the core of the third conductor at its first end, said body maintaining said third conductor and said third element so that said third element is spaced from said second element with said second element disposed between said first and third elements, said body having a second window through which air may flow extending substantially therethrough and separating said second element at its location of attachment to the core of said second conductor from the third terminal element at its location of attachment to the core of said third conductor.

5. An electrical connector, such as a plug or a receptacle, said connector comprising:

a first conductor having a first core formed of strands of metallic wire surrounded by an insulative jacket, said conductor having a first end from which said insulative jacket has been removed;

a first metallic terminal element mechanically attached to said core at said first end;

a second conductor having a second core formed of strands of metallic wire surrounded by a second insulative jacket, said second conductor having a first end from which said second jacket has been removed;

a second metallic terminal element mechanically attached to the core of said second conductor at the first end of said second conductor;

an electrically insulative body of a thermoplastic material molded about the aforementioned conductors and terminals in a first molding operation, said body having a first end and a second end and maintaining said first terminal element spaced from said second terminal element, said first and second conductors extending beyond said body at its second end and said first and second terminal elements being accessible adjacent the body first end for engagement with corresponding terminal elements of a mating electrical connector, said body having a through window which air may flow prior to filling thereof, said window extending substantially therethrough and separating the first terminal element adjacent its location of attachment to the core of said first conductor from the second terminal element adjacent its location of attachment to the core of said second conductor; and an electrically insulative outer jacket of a thermoplastic material molded about said body in a second molding operation, the last-mentioned thermoplastic material filling said window in said second molding operation, said window being spaced from said first and second terminal elements by walls of the thermoplastic material forming said body, at least one of said first and second cores having at least one loose strand extending to said window whereby the presence of said window prevents shorting of loose strands of said cores.

6. A connector as set forth in claim 5 wherein said body and said outer jacket are formed of the same material.

7. An electrical connector, such as a plug or a receptacle, said connector comprising:

a first conductor having a first core formed of strands of metallic wire surrounded by an insulative jacket, said conductor having a first end from which said insulative jacket has been removed;

a first metallic terminal element mechanically attached to said core at said first end;

a second conductor having a second core formed of strands of metallic wire surrounded by a second insulative jacket, said second conductor having a first end from which said second jacket has been removed;

a second metallic terminal element mechanically attached to the core of said second conductor at the first end of said second conductor;

an electrically insulative body of a thermoplastic material molded about the aforementioned conductors and terminals in a first molding operation, said body having a first end and a second end and maintaining said first terminal element spaced from said second terminal element, said first and second conductors extending beyond said body at its second end and said first and second terminal elements being accessible adjacent the body first end for engagement with corresponding terminal elements of a mating electrical connector, said body having a window through which air may flow prior to filling thereof, said window extending substantially therethrough and separting the first terminal element adjacent its location of attachment to the core of said first conductor from the second terminal element adjacent its location of attachment to the core of said second conductor; and an electrically insulative outer jacket of a thermoplasic material molded about said body in a second molding operation, the last-mentioned thermoplastic material filling said window in said second molding operation, said connector further comprising a third conductor having a third core formed of strands of wires surrounded by a third insulative jacket, said third conductor having a first end from which said jacket has been removed, said component also including a third metallic terminal element mechanically attached to the core of the third conductor at its first end, said body maintaining said third conductor and said third element so that said third element is spaced from said second element with said second element disposed between said first and third elements, said body having a second window through which air may flow prior to said second molding operation, said second window extending substantially therethrough and separating said second element at its location of attachment to the core of said second conductor from the third terminal element at its location of attachment to the core of said third conductor.

* * * * *

UNITED STATES PATENT AND TRADEMARK OFFICE

CERTIFICATE OF CORRECTION

PATENT NO. : 4,854,894

DATED : August 8, 1989

INVENTOR(S) : Timothy J. Harrell

It is certified that error appears in the above-identified patent and that said Letters Patent is hereby corrected as shown below:

Column 6, line 65, change "through window" to --window through--

Column 8, line 9, change "separting" to --separating--.

Column 8, lines 15-16, change "thermoplasic" to --thermoplastic--.

Signed and Sealed this

Fifth Day of June, 1990

*Attest:*

HARRY F. MANBECK, JR.

*Attesting Officer*

*Commissioner of Patents and Trademarks*